United States Patent [19]

Morgan

[11] Patent Number: 4,650,549

[45] Date of Patent: Mar. 17, 1987

[54] METHOD FOR ELECTROPLATING HELICAL ROTORS

[75] Inventor: Arvid E. Morgan, Claremore, Okla.

[73] Assignee: Hughes Tool Company, Houston, Tex.

[21] Appl. No.: 795,575

[22] Filed: Nov. 6, 1985

[51] Int. Cl.[4] ..... C25D 7/00

[52] U.S. Cl. ..... 204/25; 204/272

[58] Field of Search ..... 204/25, 272, DIG. 7

[56] References Cited

U.S. PATENT DOCUMENTS

| | | | |
|---|---|---|---|
| 534,942 | 2/1895 | Anderson | 204/212 |
| 2,539,502 | 1/1951 | Zanetti et al. | 204/224 |
| 2,940,917 | 6/1960 | Dyson | 204/212 |
| 3,637,468 | 1/1972 | Icxi et al. | 204/15 |
| 4,080,268 | 3/1978 | Suzuki et al. | 204/25 |
| 4,102,770 | 7/1978 | Moriarty | 204/212 |
| 4,235,691 | 11/1980 | Loqvist | 204/212 |

OTHER PUBLICATIONS

"Fast-Rate Electrode Position: Moving Out of the Laboratory into Industry"—Battelle Columbus Laboratories (pp. 1-3).

"Electroformed Flexible Printed Circuitry," 4 pages-G. R. Schaer & T. Wada—Jul. 1981—Reprinted from Plating and Surface Finishing.

"Process Development and Wear Performance of Fast Rate Electrodeposited Chromium on Aluminum Castings" K. F. Dufrane & G. R. Schaer—Battell Memorial Institute, pp. 1-5, Oct. 18-20, 1983.

*Primary Examiner*—T. M. Tufariello

*Attorney, Agent, or Firm*—James E. Bradley

[57] ABSTRACT

A method of electroplating helical rotors provides uniform plating depth. A positive pole electrode having a bore with the same configuration as the rotor receives the rotor, which is the cathode. The bore is larger than the rotor, providing a uniform width clearance. Electrolyte solution is pumped through the clearance while electrical current flows to cause plating. The rotor is rotated and advanced during plating.

5 Claims, 2 Drawing Figures

METHOD FOR ELECTROPLATING HELICAL ROTORS

BACKGROUND OF THE INVENTION

1. Field of the Invention

This invention relates in general to electroplating hard metal on steel surfaces, and in particular to a method for electroplating a helical progressing cavity pump rotor.

2. Description of the Prior Art

A progressing cavity pump is a well known pump of a type that has an elastomeric outer element or stator. The stator has a double lead helix in its inner surface. A metal rotor having a single lead helical exterior inserts into the stator. When the rotor is rotated, discrete cavities are created between the single and double helixes, which progress to the discharge. The discrete cavities are sealed by a design interference fit between the very hard metal rotor and the relatively soft elastomer of the stator. Typically, the rotor is hardened steel, about 35 to 60 Rockwell "C", plated with up to 0.015 inches of hard chrome.

In electroplating systems in general, a DC power supply is utilized to impress a current flow through a solution of ionized plating material, so that these ions flow to the workpiece and plate out. Metal ions are positively charged, so that in chrome plating, the workpiece is a negatively charged pole, and positive electrodes are positioned adjacent the workpiece to establish the electrical current flow through the electrolytic bath.

Normally, to plate a helical rotor, positive pole electrodes are hung parallel to the rotor, and surrounding the rotor. This results in a difference in plating rate between the minor diameter and the major diameter portions of the helical rotor. The deposit will build up to a greater depth on the portions of the rotor that are closest to the electrodes.

In the prior art, the rotor is machined with the dimensions calculated to minimize the effects of the differential plating. The final product will have accurate dimensions, even though some of the plating will have greater thickness than other portions of the plated surface. In some areas, the chrome plating will be twice the depth than in other areas, requiring more plating thickness than is necessary. The additional plating thickness is expensive. Also, uneven wear will result.

SUMMARY OF THE INVENTION

In the method and system of this invention, the positive pole electrode is made hollow, and with an internal helix contour that matches the rotor dimensions, but is a selected distance greater. The rotor can thus be axially positioned and be held equidistant at all points. The uniform annular space between the rotor and the positive pole allows even plating.

Preferably, electrolyte is pumped through the annular space, creating turbulence to enhance the plating. Also, preferably the rotor is rotated and pulled through the positive pole during plating.

BRIEF DESCRIPTION OF THE DRAWINGS

FIG's. 1*a* and 1*b* show portions of a system for electroplating a progressing cavity pump rotor in accordance with this invention.

DESCRIPTION OF THE PREFERRED EMBODIMENT

Figures 1A, 1B:
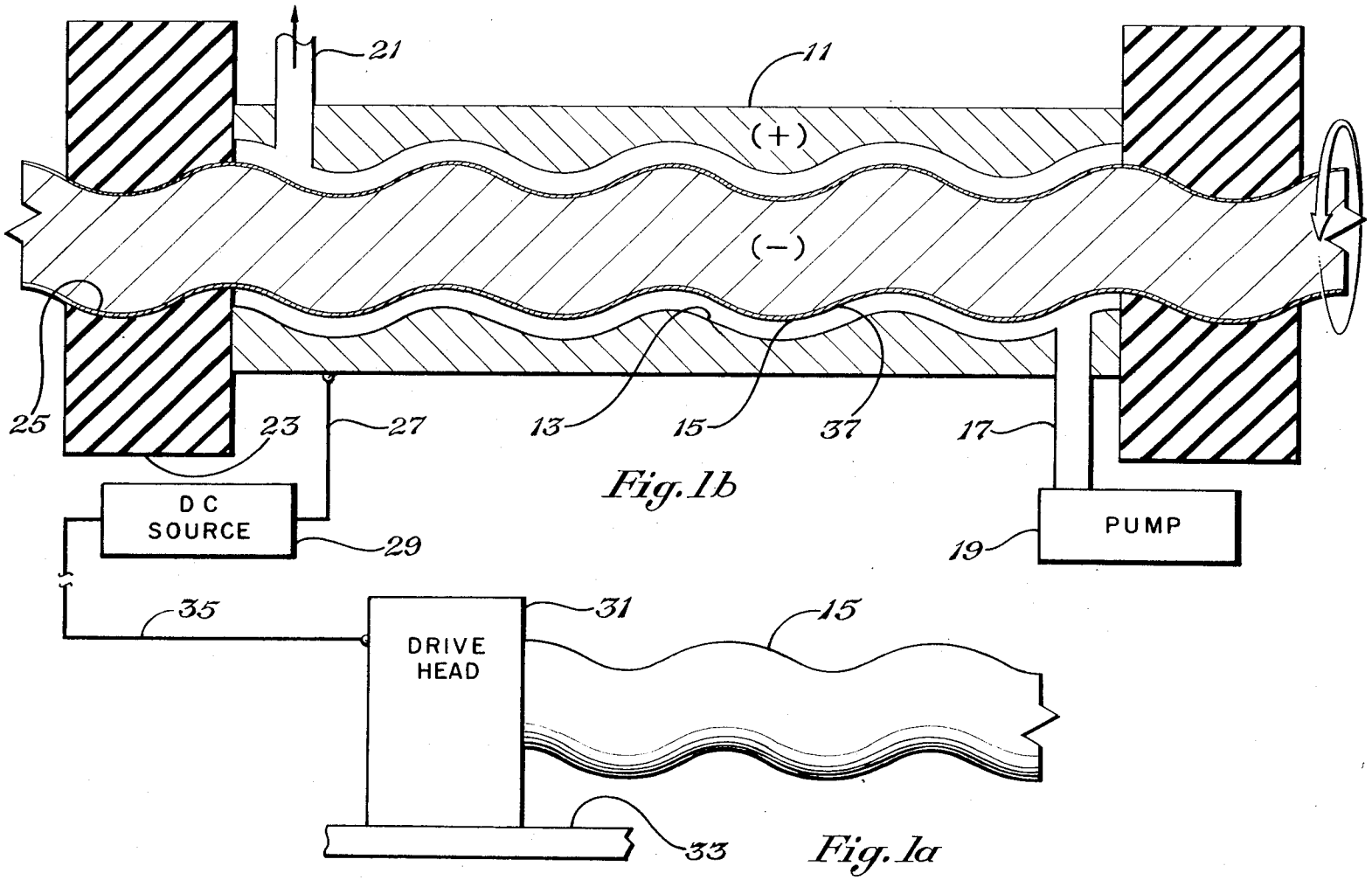

Referring to FIG. 1*b*, the system includes a positive pole electrode, which comprises a metal housing 11. Housing 11 has an internal passage 13. Passage 13 is formed with a single helix contour. The contour of passage 13 is made to match the contour of a progressing cavity pump rotor 15 of conventional design. Passage 13, however, will be a selected distance greater, allowing an annular clearance of uniform width between the interior of housing 11 and the rotor 15.

An inlet 17 is located on one end of housing 11. Inlet 17 is connected to a pump 19 for pumping electrolytic solution through the passage 13 and surrounding the rotor 15. Pump 19 will be connected to a tank (not shown) of solution containing electroplating ions, normally for plating with chrome. An outlet 21 is connected on the other end of the housing 11 for discharging the solution. The outlet 21 will return to the tank for recycling the solution.

Seals 23 are located on each end of the housing 11. The seals 23 will each have a passage 25 which is a portion of a single helix contoured to match that of the contour of rotor 15. The passage 25 will be substantially the same diameter as that of rotor 15 so as to provide a tight sealing fit to prevent leakage of electrolyte solution out of the housing 11. Seals 23 may be formed of an elastomer or of a material such as Teflon. The housing 11, being the positive pole in the system, is connected by a line 27 to a DC power supply 29. Positive DC current will be supplied to the housing 11.

FIG. 1*a* shows the forward portion of the system. Means will be provided to cause the rotor 15 to rotate in the housing 11, and simultaneously advance forwardly. Because of the single helix contour, the distance between the rotor 15 and the housing 11 at all points can be maintained equidistant if the rotor 15 is advanced and rotated, similar to a screw passing through a threaded passage.

In the preferred embodiment, a drive head 31 is mounted to the end of the rotor 15. Drive head 31 is a gear drive, electrically powered, for rotating the rotor 15 about its axis. Rotating rotor 15 will cause it to advance normally due to the close fit of the seals 23 about the rotor 15. The drive head 31 will be located on a track 33, which allows it to advance forwardly with the rotor 15 as the rotor 15 screws itself through the housing 11. Rotor 15 will be the cathode in the system. It could be grounded, or connected to a line 35 which extends between the negative side of the power supply 29 and the drive head 31.

In operation, the rotor 15, which often is 20 feet in length, will be inserted into the first seal 23. The other end will be connected to the drive head 31 for rotation. Pump 19 will be actuated to pump electrolyte solution through the passage 13 and out the outlet 21. Drive head 31 will rotate the rotor 15, which rotates about a single axis and simultaneously advances due to the threaded type of engagement with the seals 23. DC current is supplied between the housing 11 and the rotor 15, causing ions to flow and plate on the surface of the rotor 15. The numeral 37 indicates the plating building up on the surface. During rotation and advancement, the annular space between the wall of passage 13 and rotor 15 is maintained at a constant equidistant amount. Once the drive head 31 reaches the end of travel in contact with the first seal 23, then it is disengaged. The unplated end may be discarded, or the rotor 15 may be pushed forward until the extreme end clears the seal 23 to plate substantially to the end.

The invention has significant advantages. The conforming surface of the positive electrode allows the plating to be equal in thickness throughout the rotor. The equal thickness of the plating allows the rotor to be machined to size, without having to compensate for uneven plating. Savings in plating time and materials result.

While the invention has been shown in only one of its forms, it should be apparent to those skilled in the art that it is not so limited but is susceptible to various changes without departing from the scope of the invention.

I claim:

1. A method of electroplating a progressing cavity pump rotor of the type having a single helix configuration, comprising:

providing a positive pole electrode with a single helix bore with the same configuration as the rotor, but larger than the rotor, to provide a uniform clearance between the rotor and the electrode;

placing the rotor inside the electrode;

placing a solution of ionized plating material in the clearance; and applying DC voltage between the electrode and the rotor, causing electrical current to flow in the solution to plate ions in the solution onto the rotor.

2. A method of electroplating a progressing cavity pump rotor of the type having a single helix configuration, comprising in combination:

providing a positive pole electrode with a single helix bore with the same configuration as the rotor, but a selected distance larger than the rotor, providing an equidistant clearance between the rotor and the electrode;

placing the rotor inside the electrode;

flowing an electrolyte solution through the bore, surrounding the rotor; and applying DC voltage between the electrode and rotor, causing electric current to flow in the solution to plate the rotor.

3. A method of electroplating a progressing cavity pump rotor of the type having a single helix configuration, comprising in combination:

providing a positive pole electrode with a single helix bore with the same configuration as the rotor, but a selected distance larger than the rotor, providing an equidistant clearance between the rotor and the electrode;

rotating and moving the rotor forwardly through the bore at a rate to maintain the clearance uniform;

flowing an electrolyte through the bore, surrounding the rotor; and applying DC voltage between the electrode and the rotor, causing current to flow in the solution to plate the rotor.

4. An apparatus for electroplating a progressing cavity pump rotor of the type having a single helix configuration, comprising in combination:

a positive pole electrode having a single helix bore with the same configuration as the rotor, but adapted to be a selected distance larger than the rotor to provide an equidistant clearance between the rotor and the electrode;

means for locating the rotor inside the bore;

means for introducing a solution of ionized plating material in the clearance; and means for applying DC voltage between the electrode and the rotor, causing electrical current to flow in the solution to plate ions in the solution onto the rotor.

5. An apparatus for electroplating a progressing cavity pump rotor of the type having a single helix configuration, comprising in combination:

a positive pole electrode having a single helix bore with the same configuration as the rotor, but adapted to be a selected distance larger than the rotor to provide an equidistant clearance between the rotor and the electrode;

drive means for rotating and axially moving the rotor forwardly through the bore;

means for pumping a solution of ionized plating material through the bore, surrounding the rotor;

means for sealing the ends of the housing about the rotor to prevent leakage of the solution from the bore; and means for applying a DC voltage between the electrode and the rotor, causing electrical current to flow in the solution to plate ions in the solution onto the rotor.

* * * * *